United States Patent [19]

Beck

[11] 4,133,103

[45] Jan. 9, 1979

[54] COMB ASSEMBLY FOR AN ELECTRIC DRY SHAVER

[75] Inventor: William P. Beck, Westchester, Ill.

[73] Assignee: Sunbeam Corporation, Chicago, Ill.

[21] Appl. No.: 848,405

[22] Filed: Nov. 4, 1977

[51] Int. Cl.[2] ..... B26B 19/00

[52] U.S. Cl. ..... 30/43; 30/346.51

[58] Field of Search ..... 30/43, 43.91, 43.92, 30/346.51

[56] References Cited

U.S. PATENT DOCUMENTS

| | | | |
|---|---|---|---|
| 2,174,039 | 9/1939 | Muros | 30/346.51 |
| 2,346,489 | 4/1944 | Horrer | 30/346.51 X |
| 3,555,676 | 1/1971 | Bauer | 30/43.92 |
| 3,893,236 | 7/1975 | Nissen | 30/43 |

*Primary Examiner*—Robert C. Watson
*Attorney, Agent, or Firm*—Mason, Kolehmainen, Rathburn & Wyss

[57] ABSTRACT

A comb assembly for an electric dry shaver is provided with a perforated central comb panel and two end comb panels disposed adjacent the edges of the central comb panel and having long hair slots. The end panels and the central comb panels are separately fabricated from stock materials of different predetermined thicknesses and assembled to form an accurate and smoothly interfitting comb assembly. Thus, the thickness of the central comb panel is determined independent of the end comb panel thickness. The central comb panel, fabricated from a stock material of a uniformly thinner thickness than that of the end panels, requires no grinding in the fabrication of the comb and thus results in a more uniform thinner comb than obtained with grinding operations.

The separately fabricated, flexible central and end comb panels, after being fabricated with the desired predetermined patterns of perforations and elongated slots, are secured over a multiply arched comb support structure which includes a number of thin support ribs. The central and end comb panels are secured to the comb support structure by integrally formed retaining clip portions that interfit with corresponding extending tabs of the comb support structure.

The assembled comb structure is accurately positioned and releasably secured to the head of the shaver at the center of the shaver head by a latch member attached to the comb support frame and interfitting with a slidably arranged comb catch member.

19 Claims, 9 Drawing Figures

14
2
10
12
17
30
36
22
38
58
62
69
64
60
28
32
34
42
48
44
70
46
56
72

14
3
4
10
5
6
12
16
18
20
22
24
26
28
30
34
40
42
44
46
48
50
52
55
56
58
64
66
68
69
70
72
74
76
77
78
79
80
82
86
90

3
4
22
28
30
34
36
37
38
40

52
50
48
42
43
37
36
38
61
30
54
44
45
63
28
32
22
40
46
86
58
62
69
64
60
82
66
79
56
84
34
55

COMB ASSEMBLY FOR AN ELECTRIC DRY SHAVER

BACKGROUND OF THE INVENTION

A. Field of the Invention

The present invention relates generally to an electric shaver and more specifically to a comb assembly for attachment to the head of an electric dry shaver provided with a number of comb panel sections which are separately fabricated from stock materials of predetermined different thicknesses and assembled to form an accurate and smoothly interfitting comb assembly. The comb panels are secured to and retained by a ribbed comb support structure and the comb assembly is attached along the center of the head of the shaver by the interfitting of a latch member attached to the comb support structure and a comb catch slidably disposed in the shaving head.

B. Description of the Prior Art

In the electric dry shaver field there are many types of shaving heads provided with the perforated comb structures to form shearing elements with oscillating or movable cutter assemblies.

For example, U.S. Pat. Nos. 3,791,030 which issued to Jackson et al. on Feb. 12, 1974; 3,590,482 which issued to F. L. Carr on July 6, 1971 and 3,401,453 which issued to C. L. Bauer on Sept. 17, 1968 describe a shaving head comb assembly of this general type.

The perforated comb members in this type of electric dry shaver are relatively thin, flexible members which are engaged on their undersides in a shearing relationship by moving cutter assemblies. Due to the flexible nature of the perforated comb members and a necessity for an accurate relationship between the perforated comb surface and the cutter assemblies, commonly the perforated comb is supported by a ribbed support structure.

Further, to provide a close efficient shave, the perforated comb member is substantially thinner throughout a central portion and of a relatively greater thickness along the outer portions of the comb to avoid skin irritation along these portions while providing a good close shave throughout the central portion.

Commonly, the perforated comb member has been fabricated from a single piece of material and a separate grinding operation performed on the top surface of the central portion of the comb to achieve the desired thickness. The separate operation increases the manufacturing cost of the comb assembly.

In addition, mass production grinding results in a non-uniform comb thickness which presents inherent difficulty in achieving the optimum thin uniform thickness of the central portion of the comb which is critical to achieving the best possible shaving conditions, avoiding skin irritation and the prevention of early failures of the relatively flexible and thin comb member.

The assembled relationship of the comb assembly to the heat of the shaver is also important and difficult to control consistently due to the typical configuration of shavers in the prior art wherein the comb assembly is hinged along one side of the shaving head to allow cleaning and removal of various parts. Variations in the dimensional relationship of the comb assembly to the shaver head and the respective cutter blade arrangement results in unduly long lapping operations to conform the cutter blades to the comb assembly. Further, variations in the shearing relationship result whenever the comb assembly is moved from the shaving position for cleaning.

SUMMARY OF THE INVENTION

It is, therefore, a primary object of the present invention to provide a new and improved comb assembly which avoids one or more of the above-described disadvantages of the prior art arrangements.

It is another object of the present invention to fabricate a comb assembly for a dry electric shaver without a grinding operation by assembling a central perforated comb section having a first predetermined thickness with adjacent end panels interfitting with the central comb section and having a second predetermined thickness.

A further object of the present invention is to provide a comb assembly that facilitates the ease of manufacture and reduces manufacturing costs while achieving a central comb member having a first predetermined uniform thickness and adjacent interfitting panels having a second predetermined thickness.

It is another object of the present invention to provide an improved comb assembly for attachment to an electric dry shaver head wherein a perforated comb portion of the comb assembly is fabricated separately from stock material of at least two predetermined thicknesses to form a central comb member and two end panel members which are interfitted and retained over a ribbed comb support structure.

It is yet another object of the present invention to provide an improved comb assembly for an electric dry shaver wherein the perforated comb member of the comb assembly is fabricated from a multiple number of individual comb panels of various thicknesses and interfitted over a comb support structure and secured by integrally formed retaining apparatus.

It is yet another object of the present invention to provide an improved comb assembly for an electric dry shaver that is fabricated to form a perforated comb member of uniform thickness without a grinding operation in the fabrication process.

It is another object of the present invention to provide a comb assembly for an electric dry shaver which attaches to and is retained by a shaver head by the interaction of a comb latch member carried by the comb assembly and a slidably arranged catch member with the comb assembly being retained in the center of the shaving head disposed between the cutter assemblies and being retained in predetermined relationship on the shaver head.

Briefly, in accordance with one aspect of the present invention, a comb assembly for an electric dry shaver is provided having a thin flexible comb member including at least two distinct thickness portions. The comb assembly includes a central comb member fabricated from a stock material having a first predetermined thickness and at least two end panel comb members having a second predetermined thickness. The central comb member and the end panel comb members are retained to and comformed over a comb support frame by integrally formed retaining apparatus and further retained and secured to the comb support frame by a tension bar conformed to the multiply arched surface of the comb support frame. A comb latch member interfits around the comb support frame and includes portions adapted to interfit with a slidably arranged comb catch member disposed in the shaver head for releasably securing the comb head assembly in a predetermined relationship to the shaver head and the respective cutter assemblies.

The invention both as to its organization and method of operation together with further objects and advantages thereof, will best be understood by reference to the following specification taken in conjunction with the accompanying drawings.

A BRIEF DESCRIPTION OF THE DRAWINGS

For a better understanding of the invention frequent reference will be made to the drawings wherein:

FIG. 8 is an enlarged fragmentary elevational view illustrating the details of the comb panel members of the comb assembly of FIG. 7; and FIG. 9 is an enlarged fragmentary sectional view of a portion of FIG. 4.

DESCRIPTION OF THE PREFERRED EMBODIMENT

Figure 1:
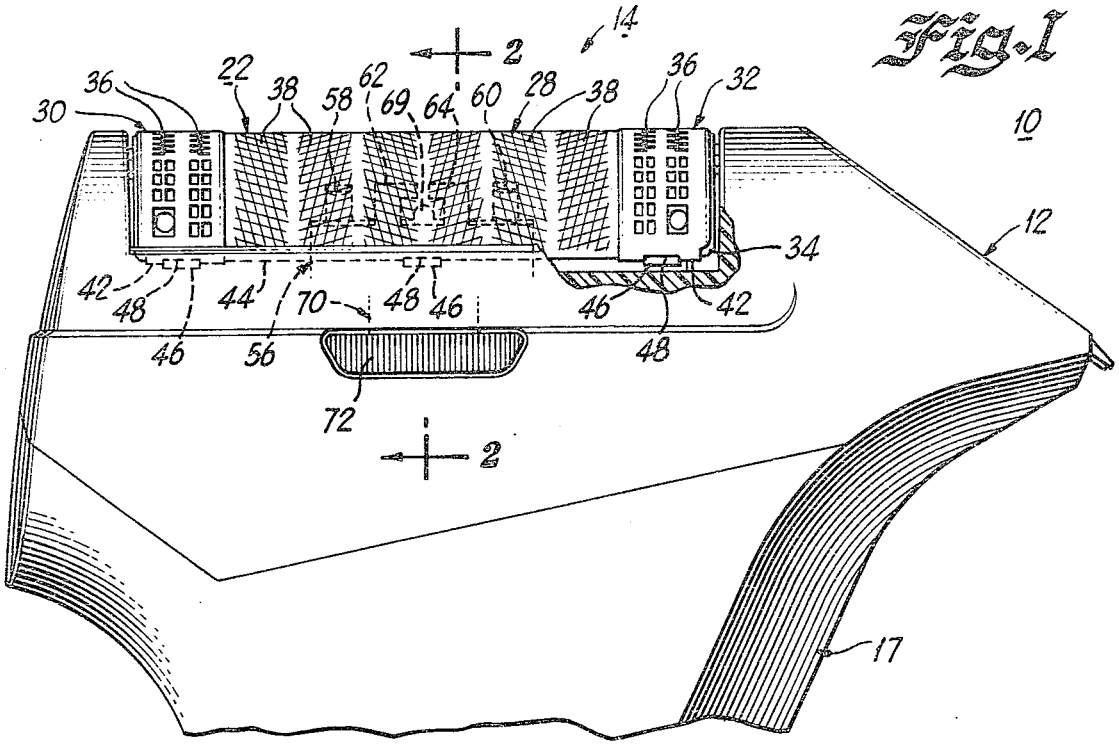
FIG. 1 is a fragmentary side elevational view of an electric dry shaver that is provided with the comb assembly of the present invention.
Figure 2:
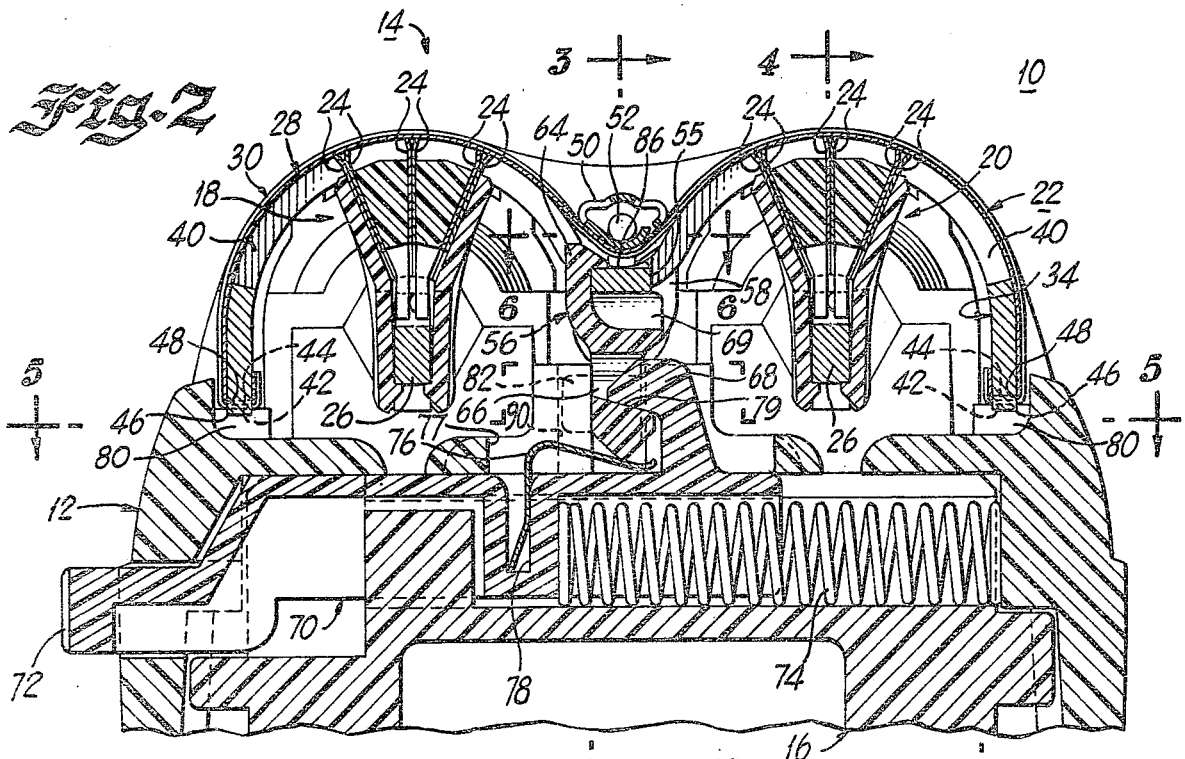
FIG. 2 is an enlarged sectional view of the comb assembly and the shaver taken along line 2—2 of FIG. 1.
Figure 3:
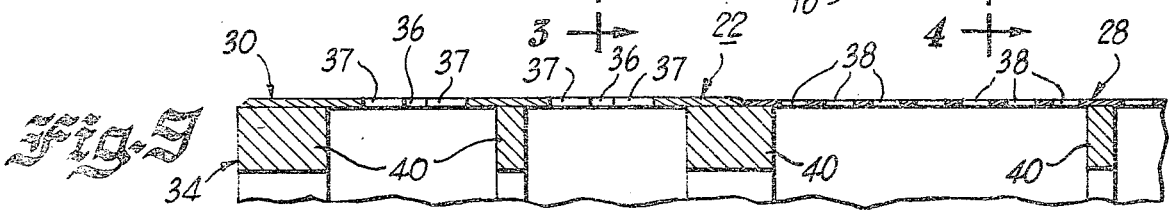
FIG. 3 is an enlarged fragmentary sectional view illustrating the details of the comb assembly and shaver head taken along line 3—3 of FIG. 2.
Figure 3:
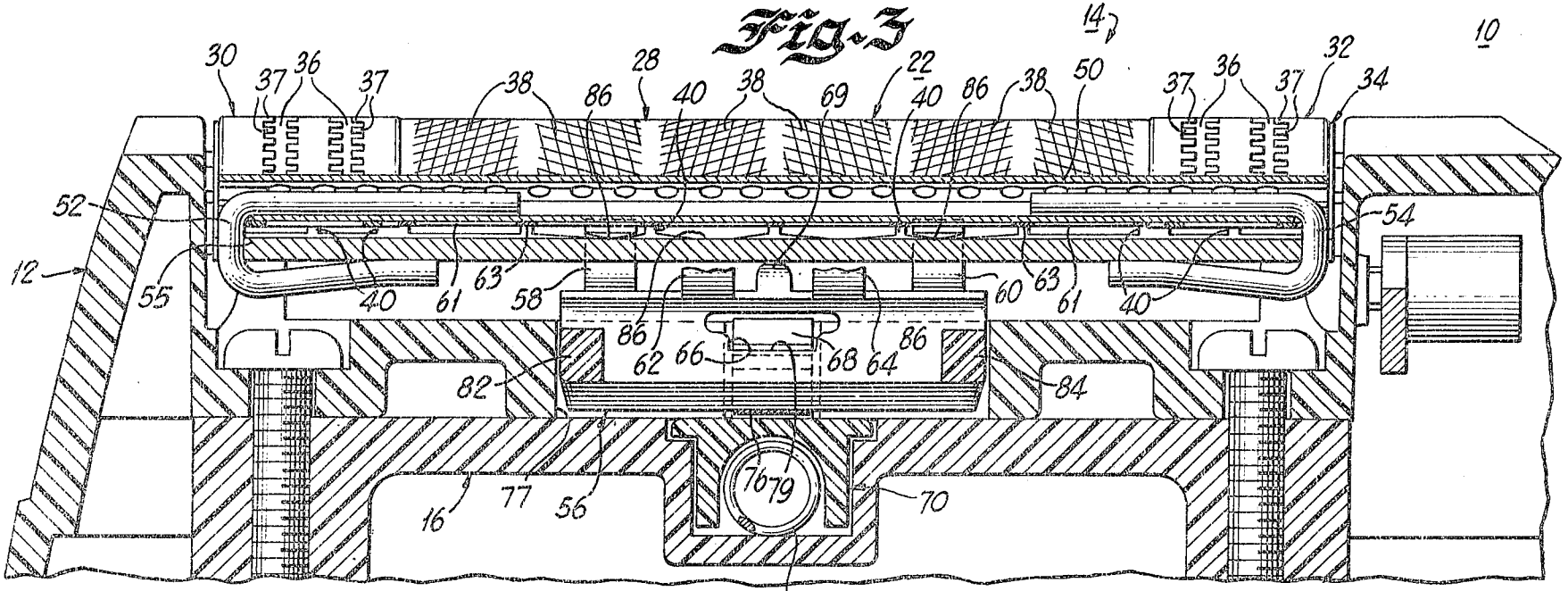
Figure 4:
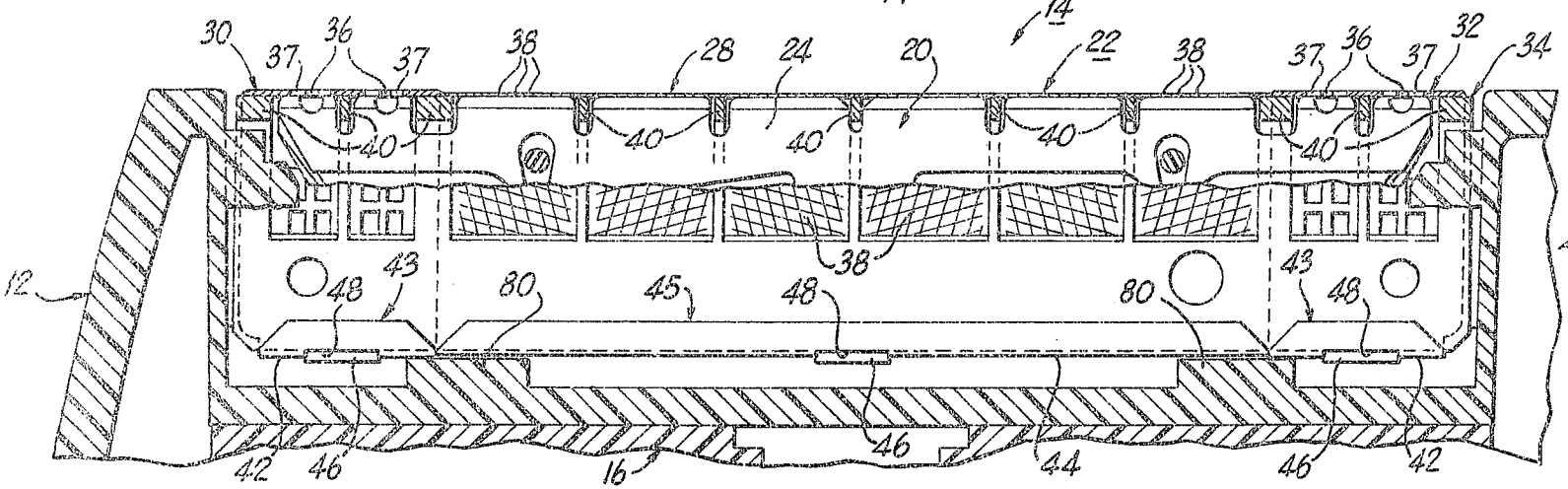
FIG. 4 is an enlarged fragmentary sectional view illustrating the details of the shaver head taken along line 4—4 of FIG. 2.
Figure 5:
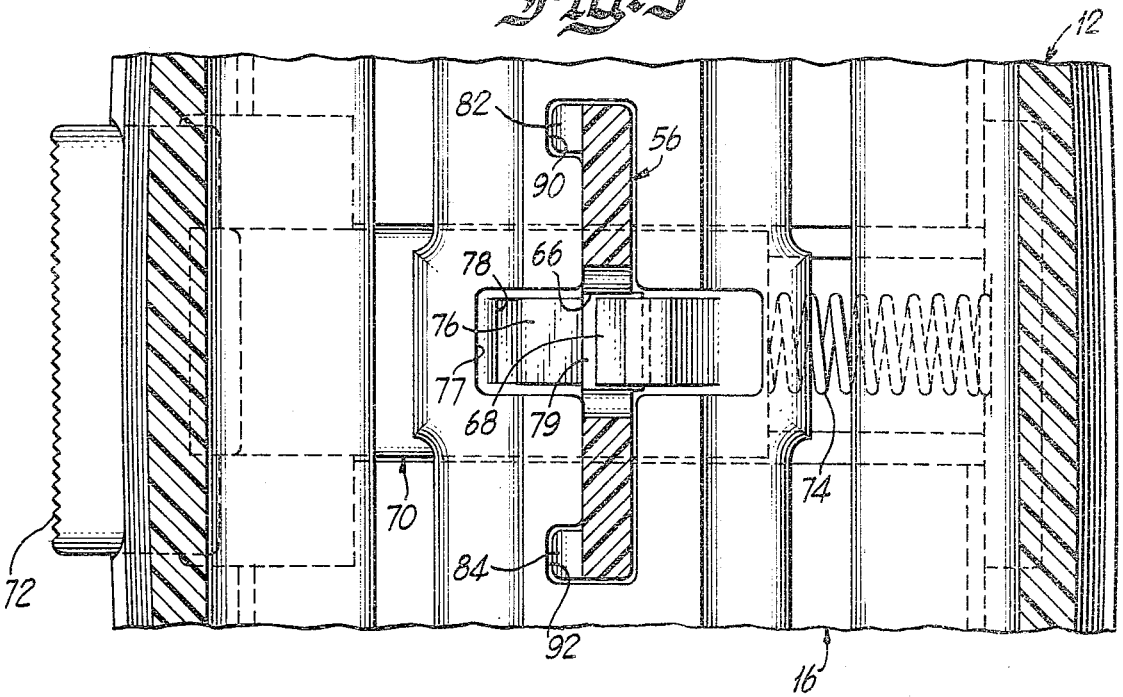
FIG. 5 is a fragmentary view partly in section illustrating the details of the comb catch member and comb latch member of the present invention taken along line 5—5 of FIG. 2.
Figure 3:
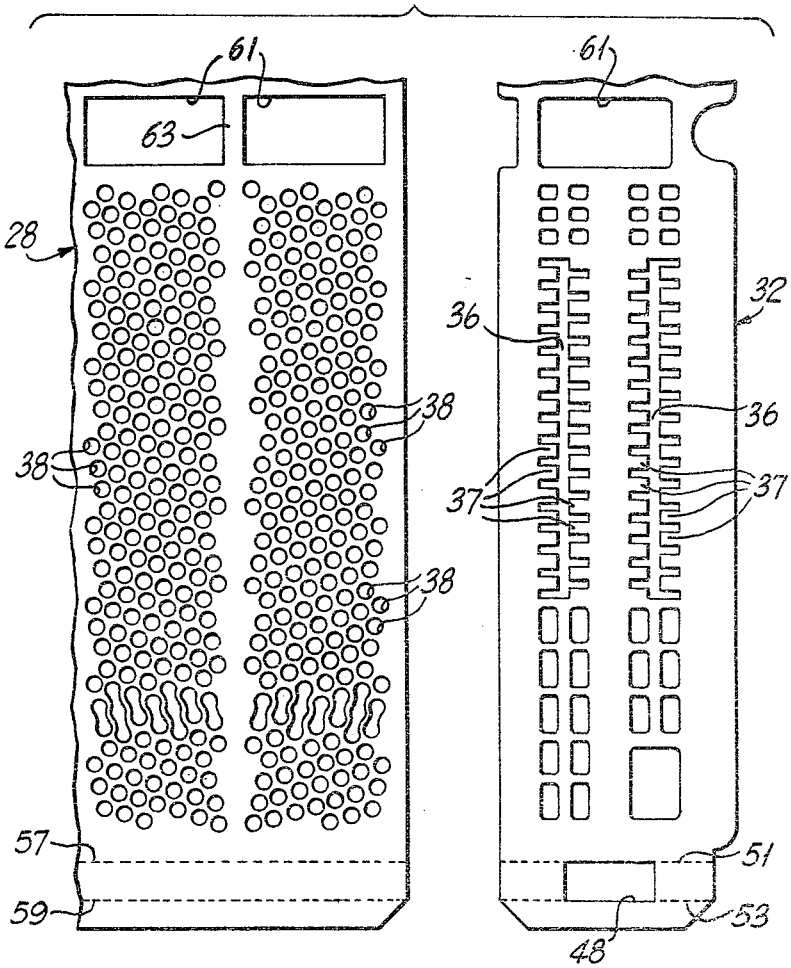

Referring to the drawings, there is shown in FIGS. 1 and 2 an electric dry shaver designated generally at 10 including an upper housing 12 on which is superimposed a shaving head assembly 14 and a lower chassis 16 on which the housing 12 is mounted. A cover 17 interfits over the lower chassis 16 and with the housing 12. As best seen in FIG. 2, the shaving head assembly 14 includes two shaving heads or shearing locations defined by the interaction of two cutter assemblies 18, 20 with a comb assembly referred to generally at 22.

The cutter assemblies 18, 20 each include a plurality of cutter blades 24 which are carried by shafts 26 for movement in shearing engagement with the underside of the comb assembly 22. Suitable drive mechanisms (not shown) connect the cutter shafts 26 to a motor (not shown) as well known in the art and their action need not be described in detail herein. The exact structure of the cutter assemblies 18, 20, the drive mechanism, the motor, associated control switch and power source connections may be substantially as shown in U.S. Pat. Nos. 3,791,030; 3,590,482 and 3,401,453, to which reference may be made for a more detailed description. In a specific embodiment, the cutter assemblies 18 and 20 are of the type described in copending application Ser. No. 851,152 filed on Nov. 14, 1977 by W. P. Beck, et al.

The comb assembly 22 includes various perforations and slotted portions in predetermined patterns and predetermined locations to accomplish the shearing action on the hairs which extends through the various perforations and slotted portions.

Figure 7:
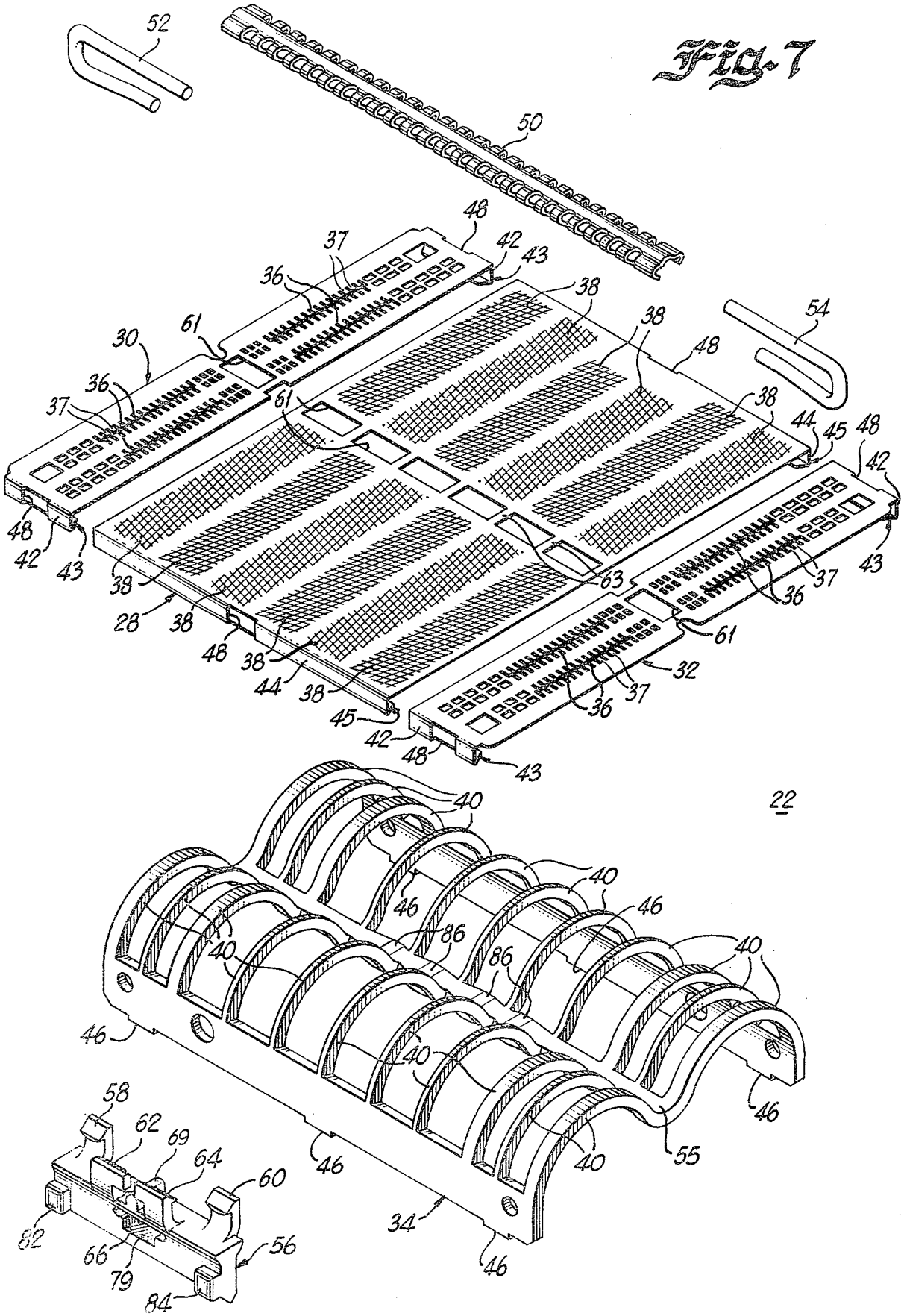
FIG. 7 is an exploded perspective view of the comb assembly.

In accordance with important aspects of the present invention and referring additionally now to FIG. 7, the comb assembly 22 in a specific embodiment is fabricated by securing a central comb panel 28 and two end comb panels 30, 32 to a comb support frame 34. The comb panel 28, 30 and 32 are generally thin, flexible planar members which are positioned over the double arched or "M" shaped comb support frame 34 and conform generally to the curved, cylindrical or double arched top surface of the comb support frame 34.

The comb support frame 34 is necessary due to the extremely thin flexible nature of the comb panels 28, 30 and 32. The comb support frame 34 is a generally open structure defined by a plurality of spaced apart parallel, double arcuate ribs 40. The ribs 40 are spaced apart in a direction running along the longitudinal axes of the cutter assemblies 18, 20 in the assembled position.

The central comb panel 28 includes a plurality of small hair holes or perforations 38. The end panels 30 and 32 include a plurality of long hair slots 36 and are fabricated from a metallic stock material of greater thickness than that of the central comb panel 28 to avoid skin irritation in these end contact areas. The thickness of the central comb panel 28 is extremely important and must be maintained within a narrow range for optimum shaving characteristics and the satisfactory life of the comb.

Thus, if a narrow uniform range of thickness cannot be maintained, the average comb must be specified to be a greater thickness reducing the optimum shaving characteristics.

For example, the finished assembled center comb panel 28 in one specific embodiment has a uniform thickness of approximately 0.0019 inches for optimum shaving characteristics after a lapping operation as well known in the art. If this thickness is not accurately maintained and the comb thickness is below 0.0019 inches, a reduced life of the comb is more probable due to denting and break-through failures.

In accordance with important aspects of the present invention, the comb panels 28, 30 and 32 are separately fabricated from stock of the desired predetermined thicknesses and etching or other suitable techniques utilized to from the short hair holes and the long hair slots in the various parts of the comb panels in a predetermined pattern.

In a preferred specific embodiment, the central comb panel 28 is fabricated from rolled stainless steel stock. Further, the comb end panels in one specific embodiment are also fabricated from stainless steel. For a final lapped-in central comb thickness of 0.0019 inches the thickness of the stock utilized in fabrication is approximately 0.0021–0.0023 to allow a predetermined additional thickness to be removed in the lapping process.

In the assembly of the comb 22, the comb panels 28, 30 and 32 are integrally fabricated with retaining clip edges 42, 44 defining channels 43, 45 respectively along the width of the comb panels 28, 30 and 32 at each end of the comb panels. The retaining clip ends 42, 44 retain the comb panels 28, 30 and 32 on the comb support frame 34 in a predetermined relationship by the interfitting of several extending tabs 46 on the comb support 34 with corresponding comb retention slots 48 formed through the retaining clip edges 42, 44.

The provision of an integrally formed retention arrangement of the comb panels 28, 30 and 32 interfitting with the comb support frame 34 eliminates the necessity of other less desirable assembly operations, welding or riveting for example. The welding or riveting operations are undesirable not only because of the cost of the separate operations and associated equipment cost but additionally because a riveting operation has a tendency to crinkle, twist or distort the flexible suspended comb structure resulting in a distortion out of the desired comb plane relative to the arcs of the cutter assemblies 18, 20.

Considering now the fabrication of the comb panels 28, 30 and 32 in more detail and in accordance with further important aspects of the present invention, the end comb panels 30 and 32 and the central comb panel 28 are each stamped either singly or in a strip that includes a plurality of individual connected panels from the stock materials of predetermined different thicknesses as discussed hereinbefore. Next and considering the end comb panels 30 and 32, the long hair slots 36 and the elongated comb retention slots 48 are etched in the end comb panel blanks. The teeth 37 of the long hair slots 36 as etched form a sharp edge on the underside that interfaces to the comb support frame 34 while the face or top side of the long hair slots 36 are etched to form a contoured, curved shape in cross-section from the underside sharp edge to the face side.

After the etching process, a light buffing operation is performed on the face side of the end panels to polish the surface and to put a small radius on the intersection of the long hair slots 36 with the face surface. The objective is to decrease the overall thickness by less than 0.0001 inches and not to extend the buffing effects beyond the top half of the depth of the long hair slots 36. Thus, the shape and the sharp edge of the bottom half of the slots 36 are determined by the etching process.

It has been found advantageous during fabrication to displace or deform the comb teeth 37 (FIG. 8) formed by the various patterns of long hair slots 36 downwardly from the plane of the comb panels 30 and 32.

Thus, when the end comb panels 30 and 32 are flexed to conform to the curved surface of the comb support frame 34, the tendency of the teeth 37 to flare outwardly projecting above the top surface of the comb assembly will be substantially avoided and minimized. If the teeth 37 are displaced downwardly a sufficient amount, after forming and assembling, none of the teeth 37 will project above the surface of the comb panels and potential skin irritation will be avoided without the necessity of a grinding operation. Any excess downward projection is eliminated by the lapping operation with the cutter assemblies 18, 20.

After the teeth 37 have been displaced downwardly or set, the retaining clip edges 42 are formed defining the channels 43. If a plurality of end comb panels 30 and 32 are fabricated in strips, the strip of comb panels 30 and 32 are trimmed and cut into individual end comb panels. The retaining clip edges 42 are formed by bending operations along the dotted lines 51 and 53. The end comb panels 30 and 32 are then ready for assembly onto the comb support frame 34.

Considering the central comb panel 28, the flat comb blank is etched to form the short hair perforations 38, the comb retention slots 48, and the correct dimensional outline of the comb. The cross-section of the etched perforations 38 are contoured or curved similarly to that of the long hair slots 36. Next, the face side is buffed to polish this surface and to break the corners of the perforations 38 to form a small radius but not to round the entry excessively. In this way, a good pick-up is obtained to speed the shave.

After the buffing operation, a light electropolish operation is performed to obtain a smooth finish. The central comb panel blanks are then trimmed to the proper dimension and the retaining clip edges 44 formed to define the channel 45 by two bending operations along the lines 57 and 59 (FIG. 8). The central comb panel 28 is now ready for assembly onto the comb support frame 34 along with the two end comb panels 30 and 32.

In addition to the perforations 38 and the comb retention slots 48, the central comb panel 28 in a specific embodiment is also etched or otherwise suitably fabricated to define a plurality of large relief openings 61 disposed along the center line of the comb panel parallel to the channels 45. The dimensions and number of relief openings 61 define a substantially open central band interrupted by narrow bridge portions 63. The provision of the relief openings 61 and bridges 63 facilitates the proper curvature and conformance of the central comb panel 28 to the comb support frame 34. Similarly, the end comb panels 30 and 32 are also each fabricated with a relief opening 61 extending substantially across the width of the panels.

The side edges of the end comb panels 30 and 32 and the central comb panel 28, connecting the retaining clip ends, are slightly rounded or finished (FIG. 9) to facilitate the interfitting of the panels on the comb assembly 22 and to provide a smooth surface across the width of the comb assembly.

The fabricated comb panels 28, 30 and 32 are then attached to the comb support frame 34 by the interfitting of the extending tabs 46 with the comb retention slots 48. The comb panels 28, 30 and 32 are further secured to and caused to conform to the shape of the upper surface of the comb support frame 34 by a tension retaining bar 50 and cooperating U-shaped tension bar spring clips 52, 54. The generally tubular shaped tension bar 50 is positioned across the center of the comb panels and in alignment with the center rail 55 of the comb support frame 34 thereby bringing the center of each of the comb panels 28, 30, 32 into closely spaced relation to the support frame and tensioning the comb across the frame. The tension bar spring clips 52 and 54 are then inserted; a first leg into the tension bar 50 and a second leg under the comb support 34 to retain the tension bar 50. The tension retaining bar 50 is fabricated from a flat blank by piercing and bending operations.

In accordance with other important aspects of the present invention, the comb assembly 22 is detachably secured and accurately positioned in a predetermined relationship over the cutter assemblies 18, 20 and on the housing 12 by the interaction of a comb latch member 56 carried by and depending downwardly from the comb assembly 22 and a slidably arranged comb catch member 68 carried by the housing 12.

Figure 6:
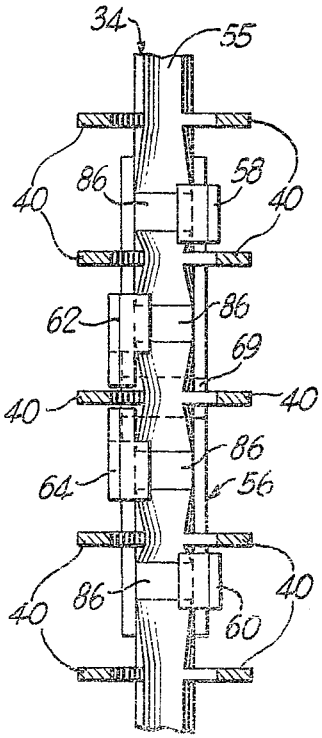
FIG. 6 is a fragmentary view partly in section illustrating the details of the comb support structure and the comb latch member taken along line 6—6 of FIG. 2.

The comb latch member 56, referring additionally now to FIG. 6, includes two upstanding spaced fingers 58 and 60 along one edge of the comb latch member 56 and two upstanding spaced fingers 62 and 64 along the opposite edge. The fingers 58, 60, 62 and 64 are disposed to interfit around the center rail 55 of the comb support frame 34. A raised tension member 69 having a semicircular cross-section is centrally formed on the top and across the width of the comb latch member 56. The tension member 69 is dimensioned to interfit with the bottom surface of the center rail 55 of the comb support frame and cooperates with the fingers 58, 60, 62 and 64 to retain and secure the comb latch 56 to the comb support frame 34.

The center rail 55 of the comb support frame 34 is fabricated in a specific embodiment to include several indented sections 86 corresponding to and aligned to receive respective ones of the fingers 58, 60, 62 and 64 of the comb latch 56 to aid in the retention and securing of the comb latch to the comb support frame 34. The comb latch member 56 further includes a passageway 66 formed therethrough which is dimensioned to accept the comb catch member 68 slidably carried in the housing 12.

The comb assembly 22 is secured at the center of the housing 12 by the comb catch member 68 between the cutter assemblies 18, 20 and is disposed within a mating receiving recess 77 of the housing 12. The comb assembly 22 is further supported and accurately positioned by extending portions or support pads.

The comb catch member 68 is fabricated as an extending finger portion of an elongated slider member 70 which extends outside the housing 12 and includes a comb catch control button 72 disposed at that end. The comb catch slider 70 is biased to an outward comb retention position by a coil spring 74 retained between the comb catch slider 70 and the chassis 16. In the outward comb retention position, the comb catch member 68 interfits through the passageway 66 of the comb latch 56. A lift spring 76 is disposed between a slotted passage 78 in the slider member 70 and the bottom surface of the extending catch member 68. The lift spring 76 is a resilient strip formed with a central bend to allow positioning between the slotted passage 78 and the bottom of the catch member 68 and provide an upward biasing force against the catch member 68. When the comb latch 56 is in the downward secured position, the lift spring 76 is deformed away from the catch member 68 by a downward sloping bottom surface 79 along the bottom of the passageway 66 of the comb latch member 56.

To accomplish cleaning, maintenance and comb assembly replacement, the comb catch control button or comb release 72 is operated and displaced to the inward position. Thus, the comb catch member 68 is disengaged from the interfitting passageway 66 of the comb latch member 56 and the lift spring 76 contacts the comb latch member 56 biasing the comb assembly 22 upward. The comb assembly 22 may then be lifted off the shaving head and the housing 12. Reassembly is accomplished by snapping the comb 22 back into engagement with the comb latch member 56.

The accurate positioning of the comb assembly 22 assures a predetermined relationship between the undersurface of the comb end panels 28, 30 and 32 and the cutter assemblies 18, 20. Thus, an optimum thickness center comb panel 28 is realizable minimizing the degree of lapping. The accurate positioning of the comb assembly 22 also facilitates the manufacturing process by the capability of lapping comb assemblies 22 with cutter assemblies 18, 20 physically remote from and prior to assembly in the housing 12 of the shaver 10. Further, for field or customer replacement of the comb and cutter assemblies, the comb and cutter assemblies may be sold as a pre-lapped replacement kit eliminating the need for further customer lap-in procedures.

The comb latch member 56 is keyed for insertion by the provision of extensions 82, 84 along one surface of the comb latch member and cooperating portions 90, 92 of the receiving recess 77 to restrict the insertion of the comb latch 56 to one predetermined orientation.

Obviously, many modifications and variations of the present invention are possible in light of the above teachings.

For example, the number and assembly relationship of the comb panels 28, 30 and 32 may be varied to provide a plurality of steps or thickness variations across the comb 22. The thickness of the end panels 30 and 32 in a specific embodiment may be tapered across the width of the comb.

Further, the number and location of the fingers 58, 60, 62 and 64 on the comb latch member 56 may be varied and disposed in various locations.

Thus, it is to be understood that, within the scope of the appended claims, the invention may be practiced otherwise than as specifically described.

What is claimed and desired to be secured by Letters Patent of the United States is:

1. A comb assembly for attachment to an electrical dry shaver having cooperating cutter assemblies comprising:

a comb support frame;

a central comb section having a first uniform predetermined thickness, attached to the central position of said comb support frame and being conformed to the outer surfaces of said comb support frame;

at least two end comb sections each having a predetermined thickness greater than said first predetermined thickness, attached to said comb support, engaging the respective abutting surfaces of said central comb section and interfitting along the side edges thereof; and means for attaching said central comb section and said end comb sections to the peripheral surfaces of said comb support frame.

2. The comb assembly of claim 1 wherein said end comb section and said central comb sections are fabricated from blanks of metallic stock materials, said end comb sections and said central comb section being fabricated from stock materials having different thicknesses.

3. The comb assembly of claim 2 wherein said different thicknesses of said stock material are related to the assembled thickness of said central comb section and said end comb sections in a predetermined manner.

4. The comb assembly of claim 1 wherein said central comb section includes a predetermined pattern of small hair perforations and said end comb sections include a predetermined pattern of long hair slots.

5. The comb assembly of claim 4 wherein said small hair perforations and said long hair slots are fabricated by etching.

6. The comb assembly of claim 5 wherein said long hair slots form a predetermined pattern of teeth on said end comb sections.

7. The comb assembly of claim 6 wherein said teeth are displaced upward and out of the plane defined by said end comb sections prior to conforming said end comb sections to said comb support frame.

8. The comb assembly of claim 1 wherein said attaching means comprises integrally formed retaining clip portions along predetermined edges on each of said comb sections and respective interfitting extending portions integrally formed on said comb support frame.

9. The comb assembly of claim 8 wherein said retaining clip portions include a right angled channel portion and slotted portions at predetermined locations along said right angled channel portions.

10. The comb assembly of claim 9 wherein said comb support frame extending portions include tab members fitting into said slotted portions.

11. The comb assembly of claim 9 wherein said right angled channel portions are fabricated by performing bending operations on said comb sections.

12. The comb assembly of claim 8 wherein said attaching means further comprises tension means centrally disposed over said central comb section, said end comb sections and said comb support frame for conforming said comb sections to said comb support frame, said tension conforming means comprising an elongated tension bar and cooperating retaining members attaching said elongated tension bar to said support frame.

13. The comb assembly of claim 8 wherein said comb support frame includes a predetermined number of multiple arches disposed for respective alignment with an equal number of cutter assemblies of said shaver to form shearing locations, said attaching means further comprises means disposed between each of said multiple arches and over said central comb section and said end comb sections for conforming said comb sections to said comb support frame.

14. The comb assembly of claim 1 further comprising means for accurately positioning and releasably securing said comb assembly on said shaver, said positioning means comprising extending portions integrally formed on said comb support frame and a comb latch member attaching along the central portion of said comb support frame, said shaver including a slidably disposed catch member, said comb latch member interfitting and cooperating with said catch member.

15. The shaver comb assembly of claim 1 further comprising means for releasably securing said comb assembly to the shaver, said releasably securing means comprising a comb latch member interfitting with said comb support frame.

16. The shaver comb assembly of claim 15 wherein said shaver further comprises catch means slidably disposed for cooperation with said comb latch member.

17. The shaver comb assembly of claim 16 wherein said catch means further comprises an elongated slider member, a catch member extending from one end of said elongated slider member and interfitting with said comb latch, and a comb catch release member extending from the other end of said slider member, said elongated slider member being operable between a comb assembly retained position and a comb assembly released position.

18. The shaver comb assembly of claim 17 wherein said catch means further comprises spring means for biasing said elongated sliding member to said comb assembly retained position.

19. The shaver comb assembly of claim 18 wherein said catch means further comprises lift spring means for urging said comb latch member to a raised position for removal when said comb catch release member is operated, said lift spring urging means being disposed between said comb latch member and said elongated slider member.

* * * * *